US010612489B2

(12) United States Patent
Jung et al.

(10) Patent No.: US 10,612,489 B2
(45) Date of Patent: Apr. 7, 2020

(54) PISTON FOR AN INTERNAL COMBUSTION ENGINE

(71) Applicant: Mahle International GmbH, Stuttgart (DE)

(72) Inventors: Frank-Peter Jung, Stuttgart (DE); Rainer Scharp, Vaihingen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 16/471,559

(22) PCT Filed: Nov. 24, 2017

(86) PCT No.: PCT/EP2017/080381
§ 371 (c)(1),
(2) Date: Jun. 19, 2019

(87) PCT Pub. No.: WO2018/114222
PCT Pub. Date: Jun. 28, 2018

(65) Prior Publication Data

US 2020/0003150 A1 Jan. 2, 2020

(30) Foreign Application Priority Data

Dec. 20, 2016 (DE) ..... 10 2016 225 632

(51) Int. Cl.
*F02F 3/22* (2006.01)

(52) U.S. Cl.
CPC ..... *F02F 3/22* (2013.01)

(58) Field of Classification Search
CPC ..... F02F 3/22; F02F 3/225; F02F 3/20; F02F 3/16; F02F 3/027; F16J 15/182
See application file for complete search history.

(56) References Cited

U.S. PATENT DOCUMENTS 3,930,472 A 1/1976 Athenstaedt
5,052,280 A 10/1991 Kopf et al.
(Continued)

FOREIGN PATENT DOCUMENTS

DE 36 43 039 A1 6/1988
DE 41 12 889 A1 10/1991
(Continued)

OTHER PUBLICATIONS

English abstract for DE-40 39 754.

*Primary Examiner* — Jacob M Amick
(74) *Attorney, Agent, or Firm* — Fishman Stewart PLLC

(57) ABSTRACT

A piston for an internal combustion engine may include a piston body including a piston skirt, a piston head, and a pocket. The piston head may include a cooling channel for receiving a cooling medium. The cooling channel may be open on a side facing away from a piston crown. The piston may also include at least one cooling channel cover at least partially closing the cooling channel, and a piston pin boss having a boss bore configured to accommodate a piston pin. The piston may further include a piston pin lubricating channel fluidically connected to the cooling channel and extending in a direction of the piston pin. The pocket may at least partially define the piston pin lubricating channel. The at least one cooling channel cover may have at least one lug that is offset radially inward and may, together with the pocket, define the piston pin lubricating channel.

20 Claims, 2 Drawing Sheets

(56) References Cited

U.S. PATENT DOCUMENTS

| | | | | |
|---|---|---|---|---|
| 5,144,923 | A | 9/1992 | Leites et al. | |
| 5,317,958 | A | 6/1994 | Martins Leites et al. | |
| 6,202,619 | B1 | 3/2001 | Keller et al. | |
| 6,453,797 | B1 | 9/2002 | Bauer | |
| 6,659,062 | B1 * | 12/2003 | Issler | F02F 3/22 123/193.6 |
| 2007/0074695 | A1 * | 4/2007 | Gildemeister | F02F 3/22 123/193.6 |
| 2012/0222632 | A1 | 9/2012 | Scharp | |

FOREIGN PATENT DOCUMENTS

| | | | |
|---|---|---|---|
| DE | 41 34 530 | A1 | 5/1992 |
| DE | 40 39 754 | A1 | 6/1992 |
| DE | 197 47 944 | A1 | 5/1999 |
| DE | 10 2011 013 139 | A1 | 9/2012 |
| FR | 2 246 742 | A1 | 5/1975 |
| WO | WO-2007/076811 | A2 | 7/2007 |

* cited by examiner

PISTON FOR AN INTERNAL COMBUSTION ENGINE

CROSS-REFERENCE TO RELATED APPLICATIONS

This application claims priority to International Patent Application No. PCT/EP2017/080381, filed on Nov. 24, 2017, and German Patent Application No. DE 10 2016 225 632.7, filed on Dec. 20, 2016, the contents of both of which are hereby incorporated by reference in their entirety.

TECHNICAL FIELD

The present invention relates to a piston for an internal combustion engine, having a piston body comprising a piston skirt and a piston head. The invention furthermore relates to an internal combustion engine having at least one such piston.

BACKGROUND

Internal combustion engines of the type in question are sufficiently well known and are already being employed in many forms in motor vehicle construction. To be able to enhance the performance of the pistons and hence also of the internal combustion engine in this context, the pistons are additionally cooled in regions subject to high thermal stress, e.g. in a combustion chamber recess and/or on a fire land, for which purpose a circumferential cooling channel is generally arranged in the piston head. Arranged in this cooling channel is a cooling medium, which brings about improved heat transfer from the combustion chamber recess or the fire land to cooler regions on a lower side of the piston. In the case of open cooling channels, cooling oil is generally sprayed into said channels. In this case, a cooling channel of this kind has at least one cooling oil inlet and at least one cooling oil outlet, through which the cooling oil is fed to the cooling channel and discharged therefrom. In the case of one-piece pistons, the cooling channel is often formed with an additional cooling channel cover attached afterwards. These cooling channel covers, which are shaped as sheet-metal rings for example, are sufficiently well known from the prior art.

DE 40 39 754 A1 discloses a piston of the type in question for an internal combustion engine, which has a sheet-metal ring for covering an annular cavity for receiving a cooling oil. On the one hand, the collar of the sheet-metal ring rests in a recess in an annular wall and, on the other hand, the sheet-metal ring is supported on a boss bush under preload by means of a holding strap. In order to increase piston pin lubrication at the same time as achieving improved piston cooling, beads are arranged on the sheet-metal ring in order to guide some of the cooling oil onto the piston pin boss. The disadvantage here is that the cooling oil does not impinge selectively on the piston pin boss but instead drips off in an uncontrolled manner and, as a result, efficient piston pin lubrication is impossible.

In order to achieve selective piston pin lubrication, "lubricating bores" leading in the direction of the piston pin from the cooling channel are often introduced, or cooling oil discharge bores leading in the direction of the piston pin boss are provided. For example, WO 2007/076811 A2 discloses a piston for an internal combustion engine which, in addition to an annular cooling channel in the piston head, has at least one oil feed bore and at least one oil discharge bore, each of which is aligned in the direction of the piston pin boss for the sake of cooling the latter. The disadvantage with such bores is that they have to be introduced subsequently by means of an additional work step, thereby increasing production costs.

SUMMARY

The present invention is therefore concerned with the problem of specifying an improved or at least an alternative embodiment for an internal combustion engine of the type in question, which embodiment, in particular, overcomes the disadvantages known from the prior art and can furthermore be produced at reasonable cost from a manufacturing point of view.

According to the invention, this problem is solved by the subject matter of the independent claim(s). Advantageous embodiments form the subject matter of the dependent claim(s).

The present invention is based on the general concept of enhancing the performance and service life of an internal combustion engine by designing a piston pin lubricating channel fluidically connected to a cooling channel to direct a cooling medium selectively onto a piston pin or a piston pin boss in order to allow both cooling and lubrication of precisely this piston pin or precisely this piston pin boss. For this purpose, the fundamental approach is to forge into a piston blank a kind of pocket which forms at least part of the piston pin lubricating channel. This is accomplished at neutral cost since all that is necessary is adaptation of the forging tool. A subsequently introduced cooling channel cover is provided with a lug which, together with the pocket, forms the piston pin lubricating channel on the piston blank. In this way, the piston pin lubricating channel can be formed without expensive subsequent bores and, as a result, lower-cost production can be achieved. Here, the piston according to the invention for an internal combustion engine of this kind has at least one piston body comprising a piston skirt and a piston head, wherein the piston head has an at least partially circumferential cooling channel of this kind for receiving the cooling medium, which cooling channel is open on a side facing away from a piston crown. The cooling channel is at least partially closed by the cooling channel cover. The piston furthermore has a piston pin boss, preferably two such piston pin bosses spaced apart from one another, in each of which a boss bore is provided to accommodate the piston pin. Moreover, the piston has the piston pin lubricating channel, which is fluidically connected to the cooling channel and runs in the direction of the piston pin. A pocket of this kind is formed on the piston body, which pocket at least partially forms the piston pin lubricating channel. The cooling channel cover has at least one lug of this kind, which is offset radially inward and, together with the pocket, forms the piston pin lubricating channel on the piston body. The dimensioning of the piston pin lubricating channel can be performed through the design of the pocket on the piston body in combination with the design of the lug of the cooling channel cover. Through the shaping of the piston pin lubricating channel, selective lubrication between the piston pin bosses and the piston pin arranged thereon can be achieved.

In an advantageous development of the piston according to the invention, the piston pin lubricating channel is aligned in such a way that a cooling medium flowing through impinges on at least one piston pin boss of this kind and/or one piston pin of this kind. That is to say that the piston pin lubricating channel preferably extends from the cooling channel at least as far as a region in the interior of the piston in which it is possible for such a cooling medium flowing through the piston pin lubricating channel to impinge at least on the piston pin boss or the piston pin. It is particularly preferred if the cooling medium impinges on those points at which there can be mechanical motion, e.g. between the piston pin and the piston pin bosses, if the piston pin is provided with floating support, and, for example, between the piston pin and a connecting rod arranged thereon.

In another expedient development, the cooling channel cover is designed as a two-part sheet-metal ring, which has at least one cooling medium inlet opening and one cooling medium outlet opening. A two-part sheet-metal ring can significantly facilitate subsequent mounting on the piston body. The cooling medium inlet opening and the cooling medium outlet opening are preferably each arranged between the adjacent sheet-metal ring parts, thereby making it possible to eliminate a subsequent bore for the penetration of the sheet-metal parts, for example.

In an advantageous variant embodiment of the concept according to the invention, two pockets spaced apart by 180° in the circumferential direction are formed on the piston body. Moreover, the cooling channel cover has two lugs, likewise spaced apart by 180° and offset radially inward, and, together with the two pockets, these consequently each form two such piston pin lubricating channels offset by 180°. In accordance with the concept of the invention, any number of piston pin lubricating channels for a piston of this kind in such an internal combustion engine is conceivable and equally protected.

In another advantageous embodiment, the cooling channel cover is clamped, in particular under a preload, between an annular wall and an annular rib. For this purpose, it is possible to arrange on the annular wall a recess into which a radially outer contour of the cooling channel cover extends, ensuring that the cooling channel cover is held axially and radially. Furthermore, the radially inner contour of the cooling channel cover, with the exception of the region of the lug, can be supported on the piston body and/or on a piston pin boss of this kind.

Another advantageous embodiment envisages that the cooling channel cover has at least one radial longitudinal section, in particular in the region of the lug, which is deep drawn on a side facing away from the piston crown. The deep-drawn longitudinal section of the cooling channel cover is expediently formed on a side facing the piston pin. The cooling channel cover may have an identical contour, e.g. in the region of the pocket, as the shape of such a pocket, as a result of which the piston pin lubricating channel which forms has a constant axial height by virtue of the constant axial spacing between the pocket and the cooling channel cover.

In another advantageous variant embodiment, the cooling channel cover, in particular the lug, has a drip edge on a radially inner longitudinal end, said edge projecting over at least one piston pin of this kind. The radial overlap of the cooling channel cover in the form of the drip edge enables the cooling medium to drip onto the piston pin.

Another advantageous embodiment envisages that the piston is designed as a steel piston or as a cast piston, e.g. composed of gray cast iron, and/or that the cooling medium comprises, in particular, a cooling oil. It is expedient if the cooling oil is used both for cooling and for a lubricating the mechanically movable components. The piston can preferably be designed as a one-piece steel piston, while it is possible to refer to a multi-part piston after the arrangement of the cooling channel cover.

Further important features and advantages of the invention will become apparent from the subclaims, from the drawings and from the associated description of the figures with reference to the drawings.

It is self-evident that the features mentioned above and those that will be explained below can be used not only in the respectively indicated combination but also in other combinations or in isolation without exceeding the scope of the present invention.

Preferred illustrative embodiments of the invention are shown in the drawings and are explained in greater detail in the following description, in which the same reference signs relate to identical or similar or functionally identical components.

BRIEF DESCRIPTION OF THE DRAWINGS

In the drawings, in which each of the figures is schematic.

DETAILED DESCRIPTION

Figure 1:
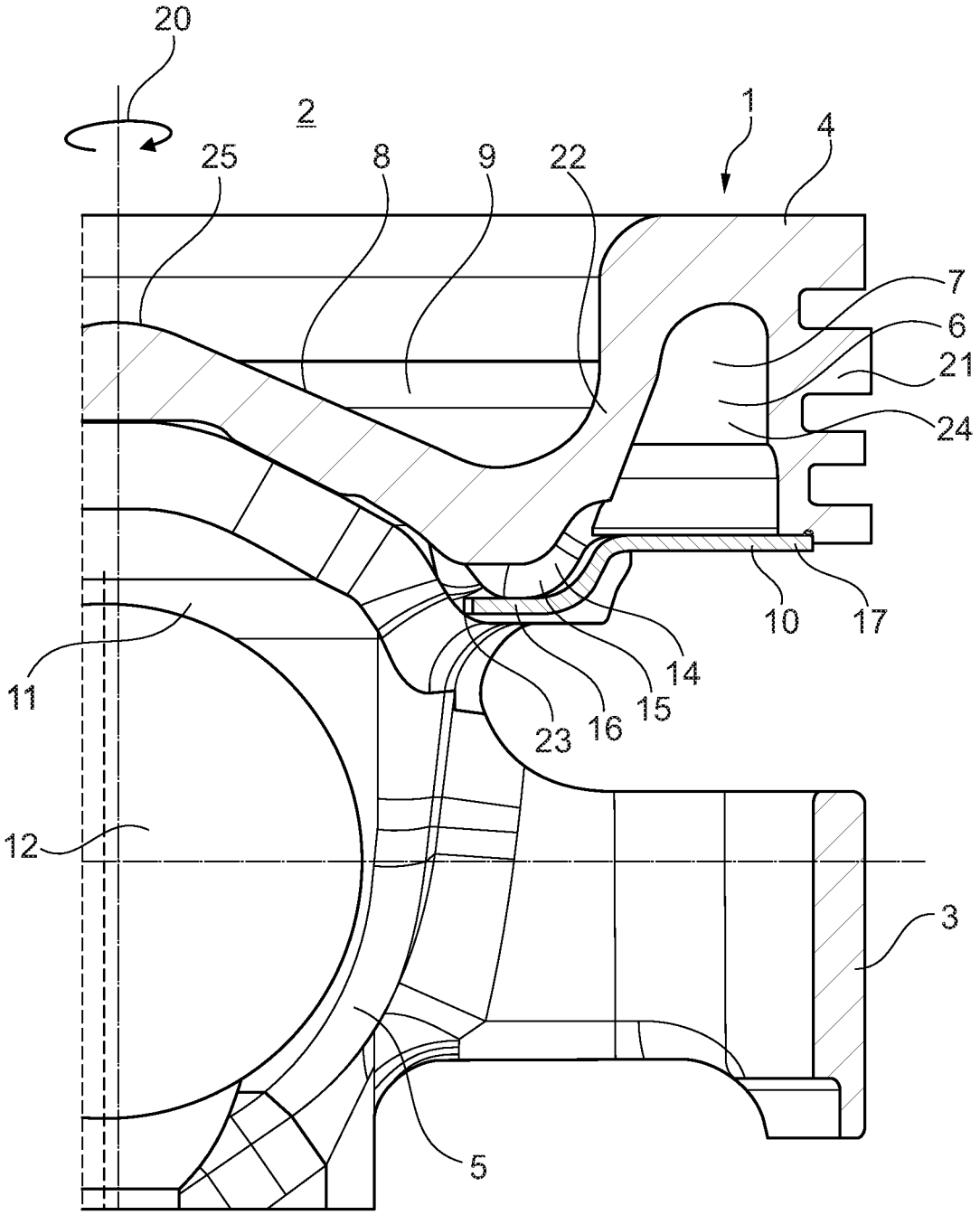
FIG. 1 shows a section through a piston according to the invention for an internal combustion engine in the region of a piston pin lubricating channel.

FIG. 1 shows a section through a piston 1 according to the invention for an internal combustion engine 2, otherwise not shown, as a detail view in the region of a piston pin lubricating channel 14. The piston 1 is designed as a substantially one-piece piston body 5, wherein the piston 1 may be referred to as a multi-part piston 1 by virtue of a subsequently fitted cooling channel cover 10, which is explained in greater detail below. The piston body 5 has a piston skirt 3 and a piston head 4, wherein an at least partially circumferential cooling channel 6 for receiving a cooling medium 7 is formed in the piston head 4. Radially toward the outside, the cooling channel 6 is bounded by an annular wall 21 and, radially toward the inside, is bounded by an annular rib 22. The cooling channel 6 is of open design on a side facing axially away from a piston crown 8. In the region of the piston crown 8, the piston 1 furthermore has a combustion chamber recess 9 with a central dome 25. Of course, the dome 25 can also be arranged noncentrally. Moreover, the piston 1 shown has two mutually spaced piston pin bosses 11, which each have a boss bore 12 to accommodate a piston pin, which is not otherwise shown. The piston pin can be clamped in the piston pin bosses 11 in a fixed manner or, preferably, can be mounted in a floating manner in the piston pin bosses 11. To cover the cooling channel 6, the cooling channel cover 10 already mentioned above, which at least partially closes the cooling channel 6, is provided. A pocket 15, which forms at least part of the piston pin lubricating channel 14, is arranged on the piston body 5 on a side facing away from the combustion chamber recess 9, in the region of the transition from the annular rib 22 to the piston crown 8. According to FIG. 1, the arrangement of the pocket 15 gives rise to the formation of a part of the piston pin lubricating channel 14 which is closed with respect to the piston crown 8 and on both sides in the circumferential direction 20. The piston pin lubricating channel 14 extends radially outward into the cooling channel 6 and radially inward at least in the direction of the piston crown or in the direction of the piston pin bosses 11. The cooling channel 6 and the piston pin lubricating channel 14 are thus connected fluidically to one another. To cover the piston pin lubricating channel 14 axially, the cooling channel cover 10 has, in the region of the pocket 15, a lug 16, which is offset radially inward and, together with the pocket 15, forms the piston pin lubricating channel 14 on the piston body 5.

The piston pin lubricating channel 14 can preferably be configured in such a way that the cooling medium 7 flows via the cooling channel 6 through the piston pin lubricating channel 14 and then impinges directly on the piston pin boss 11 or the piston pin. Moreover, the piston 1 according to the invention can have two piston pin lubricating channels 14 which are offset by 180° in the circumferential direction 20 and which are each formed by two pockets 15 on the piston body 15 and two lugs 16 on the cooling channel cover 10.

The cooling channel cover 10 can be clamped under a preload between the annular wall 21 and the annular rib 22. For this purpose, groove-shaped recesses, into which the cooling channel cover 10 extends and in which it can be supported, can be provided respectively on the annular wall 21 and/or on the annular rib 22. It is likewise conceivable for the cooling channel 10 to undergo a certain curvature under the preload. Furthermore, the cooling channel cover 10 can have a drip edge 23 on a radially inner longitudinal end, in particular on a radially inner longitudinal end of the lug 16. This drip edge 23 can project radially inward over at least one piston pin of this kind, as a result of which the cooling medium 7 dripping off the drip edge 23 impinges vertically on the piston pin.

The piston 1 as such can expediently be designed as a steel piston or as a cast piston 1, e.g. composed of gray cast-iron or precision cast material. Moreover, the cooling medium 7 can be a cooling oil 24, which, on the one hand, has at least a certain thermal conductivity to allow cooling of the vacant locations and, on the other hand, has a certain lubricating capacity to ensure that wear on the mechanically moved components is reduced.

Figure 2:
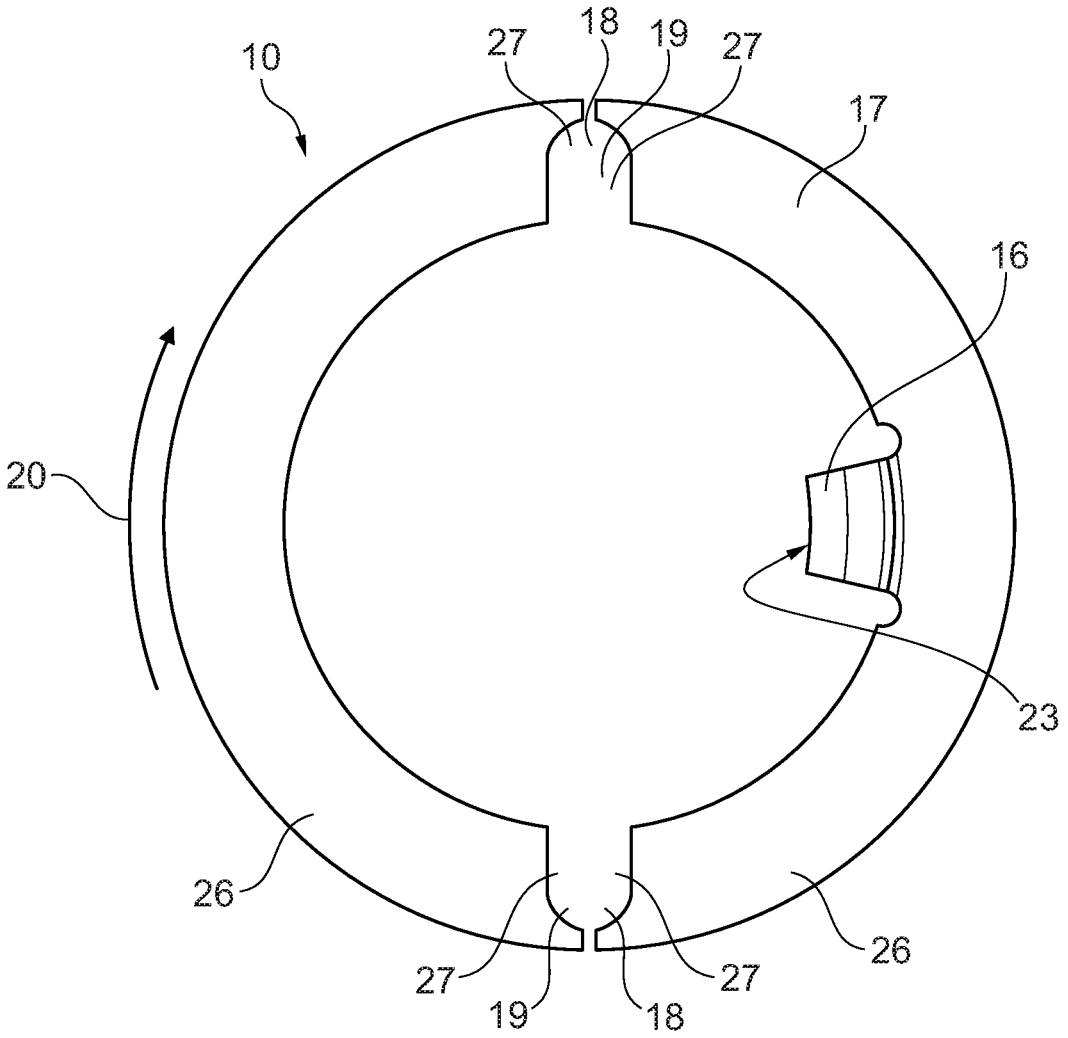
FIG. 2 shows a plan view of a cooling channel cover, which is shaped as a two-part sheet-metal ring, on which is arranged a single lug.

FIG. 2 shows a plan view of a cooling channel cover 10 of this kind, which is shaped as a two-part sheet-metal ring 17 with a single lug 16 arranged thereon. Respective recesses 27, which are provided as a cooling medium inlet opening 18 and/or as a cooling medium outlet opening 19, can be arranged on the opposite sides of the sheet-metal ring sections 26 of the two-part sheet-metal ring 17, said sections being mirror-symmetrical with the exception of the lug 16. It is likewise conceivable for the cooling channel cover 10 to have two lugs 16, which are each arranged spaced apart by 180°. The lug 16 projects radially inward and can be pressed out axially from the remainder of the sheet-metal ring 17 as such. For example, the lug 16 may be deep drawn at least over a radial longitudinal section of a side facing or facing away from the piston crown 8.

The invention claimed is:

1. A piston for an internal combustion engine, comprising:

a piston body including a piston skirt and a piston head;

the piston head including an at least partially circumferential cooling channel for receiving a cooling medium, the cooling channel open on a side facing away from a piston crown;

at least one cooling channel cover at least partially closing the cooling channel;

a piston pin boss having a boss bore configured to accommodate a piston pin;

a piston pin lubricating channel fluidically connected to the cooling channel and extending in a direction of the piston pin;

a pocket disposed on the piston body, the pocket at least partially defining the piston pin lubricating channel; and wherein the at least one cooling channel cover has at least one lug that is offset radially inward and, together with the pocket, defines the piston pin lubricating channel.

2. The piston as claimed in claim 1, wherein the piston pin lubricating channel is aligned such that the cooling medium flowing therethrough impinges on at least one of the piston pin boss and the piston pin.

3. The piston as claimed in claim 1, wherein the at least one cooling channel cover is structured as a two-part sheet-metal ring having at least one cooling medium inlet opening and at least one cooling medium outlet opening.

4. The piston as claimed in claim 1, wherein:

a second pocket is disposed on the piston body spaced apart by 180° in a circumferential direction from the pocket; and at least one lug includes two lugs spaced apart by 180° in the circumferential direction and offset radially inward.

5. The piston as claimed in claim 1, wherein the at least one cooling channel cover is clamped between an annular wall of the piston head and an annular rib of the piston head.

6. The piston as claimed in claim 1, wherein the at least one cooling channel cover has at least one radial longitudinal section which is deep drawn on a side facing away from the piston crown.

7. The piston as claimed in claim 1, wherein the at least one cooling channel cover includes a drip edge on a radially inner longitudinal end, the drip edge projecting over at least one piston pin.

8. The piston as claimed in claim 1, wherein at least one of:

the piston is one of a steel piston and a cast piston; and the cooling medium is a cooling oil.

9. An internal combustion engine comprising at least one cylinder in which a piston is arranged, the piston including:

a piston body including a piston skirt and a piston head;

the piston head including an at least partially circumferential cooling channel for receiving a cooling medium, the cooling channel open on a side facing away from a piston crown;

at least one cooling channel cover at least partially closing the cooling channel;

a piston pin boss having a boss bore configured to accommodate a piston pin;

a piston pin lubricating channel fluidically connected to the cooling channel and extending in a direction of the piston pin;

a pocket disposed on the piston body, the pocket at least partially defining the piston pin lubricating channel; and wherein the at least one cooling channel cover has at least one lug that is offset radially inward and, together with the pocket, defines the piston pin lubricating channel.

10. The internal combustion engine as claimed in claim 9, wherein the piston pin lubricating channel is aligned such that the cooling medium flowing therethrough impinges on at least one of the piston pin boss and the piston pin.

11. The internal combustion engine as claimed in claim 9, wherein the at least one cooling channel cover is structured as a two-part sheet-metal ring having at least one cooling medium inlet opening and at least one cooling medium outlet opening.

12. The internal combustion engine as claimed in claim 9, wherein:

a second pocket is disposed on the piston body spaced apart by 180° in a circumferential direction from the pocket; and the at least one lug includes two lugs spaced apart by 180° in the circumferential direction and offset radially inward.

13. The internal combustion engine as claimed in claim 9, wherein the at least one cooling channel cover is clamped between an annular wall of the piston head and an annular rib of the piston head.

14. The internal combustion engine as claimed in claim 9, wherein the at least one cooling channel cover has at least one radial longitudinal section which is deep drawn on a side facing away from the piston crown.

15. The internal combustion engine as claimed in claim 14, wherein the at least one radial longitudinal section is disposed in a region of the at least one lug.

16. The internal combustion engine as claimed in claim 9, wherein the at least one cooling channel cover includes a drip edge on a radially inner longitudinal end, the drip edge projecting over at least one piston pin.

17. The internal combustion engine as claimed in claim 9, wherein the at least one cooling channel cover includes a drip edge on a radially inner longitudinal end of the at least one lug, the drip edge projecting over at least one piston pin.

18. The internal combustion engine as claimed in claim 9, wherein at least one of:

the piston is one of a steel piston and a cast piston; and the cooling medium is a cooling oil.

19. The piston as claimed in claim 1, wherein the at least one cooling channel cover includes a drip edge on a radially inner longitudinal end of the at least one lug, the drip edge projecting over at least one piston pin.

20. The piston as claimed in claim 6, wherein the at least one radial longitudinal section is disposed in a region of the at least one lug.

* * * * *